United States Patent [19]

Bione et al.

[11] 4,300,430

[45] * Nov. 17, 1981

[54] CHORD RECOGNITION SYSTEM FOR AN ELECTRONIC MUSICAL INSTRUMENT

[75] Inventors: Angelo A. Bione, Chicago; Robert J. Sehnert, Palatine; Horace E. Taylor, Skokie, all of Ill.

[73] Assignee: Marmon Company, Chicago, Ill.

[ * ] Notice: The portion of the term of this patent subsequent to Mar. 20, 1996, has been disclaimed.

[21] Appl. No.: 913,358

[22] Filed: Jun. 7, 1978

Related U.S. Application Data

[63] Continuation-in-part of Ser. No. 804,739, Jun. 8, 1977, Pat. No. 4,144,788.

[51] Int. Cl.[3] ..... G10H 1/38

[52] U.S. Cl. ..... 84/1.01; 84/1.03; 84/DIG. 22

[58] Field of Search ..... 84/1.01, 1.03, 1.24, 84/DIG. 22

[56] References Cited

U.S. PATENT DOCUMENTS

| | | | |
|---|---|---|---|
| 3,825,667 | 7/1974 | Schrecongost | 84/DIG. 22 |
| 4,019,417 | 4/1977 | Carlson | 84/1.01 |
| 4,059,039 | 11/1977 | Carlson | 84/1.01 |
| 4,065,993 | 1/1978 | Hirose | 84/DIG. 22 |
| 4,138,918 | 2/1979 | Kato | 84/1.03 |
| 4,142,433 | 3/1979 | Gross | 84/1.24 |
| 4,144,788 | 3/1979 | Bione | 84/1.01 |

*Primary Examiner*—Stanley J. Witkowski

*Attorney, Agent, or Firm*—Neuman, Williams, Anderson & Olson

[57] ABSTRACT

A chord recognition system for an electronic musical instrument, namely an electronic organ. A shift register receives data information from the keying lines of selected playing keys. The pattern of the received data is compared against selected normalized chord patterns in a program logic array to determine if the note input sequence is in a known musical relationship such as major, minor, minor sixth, seventh or others. A chord logic circuit receives the information from the programmed logic circuit and further reduces the information to output signals indicating a major, minor, or seventh chord and a pattern found signal. If no chord pattern is detected in the input data sequence, the register shifts the data on its first input line to its last input line and all other data is transferred downward accordingly. A counter sequences at each shift of the data input information. The shifted data is now compared in the programmed logic array as described above. This operation is repeated until a pattern match is found or an entire shift cycle is complete. The type of chord being played is indicated by the output of the chord logic circuit and the root or alphabetic key of the chord being played is indicated by the output of the counter. Each step of the counter indicates a different root or tonic note. Thus, the system recognizes normalized chord patterns and tracks the alphabetic key for recognizable chord patterns. The output from the chord logic circuit and the counter are used as inputs to other organ circuits such as a visual display circuit to illustrate to the organist the chord being played.

25 Claims, 3 Drawing Figures

FIG. 1
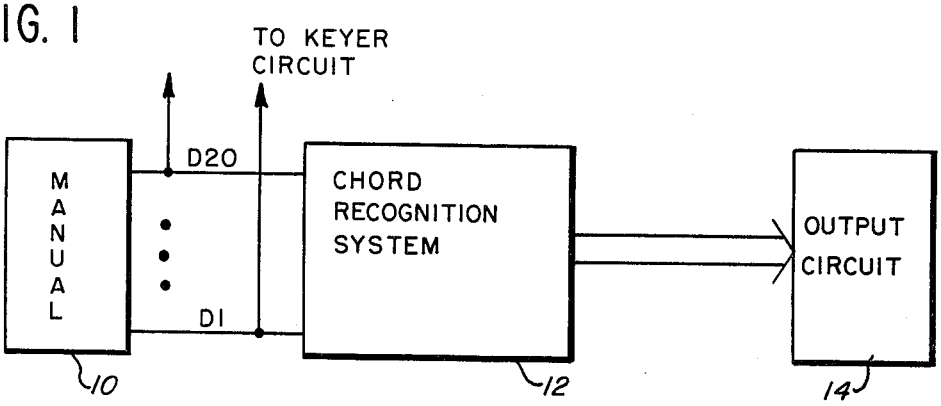
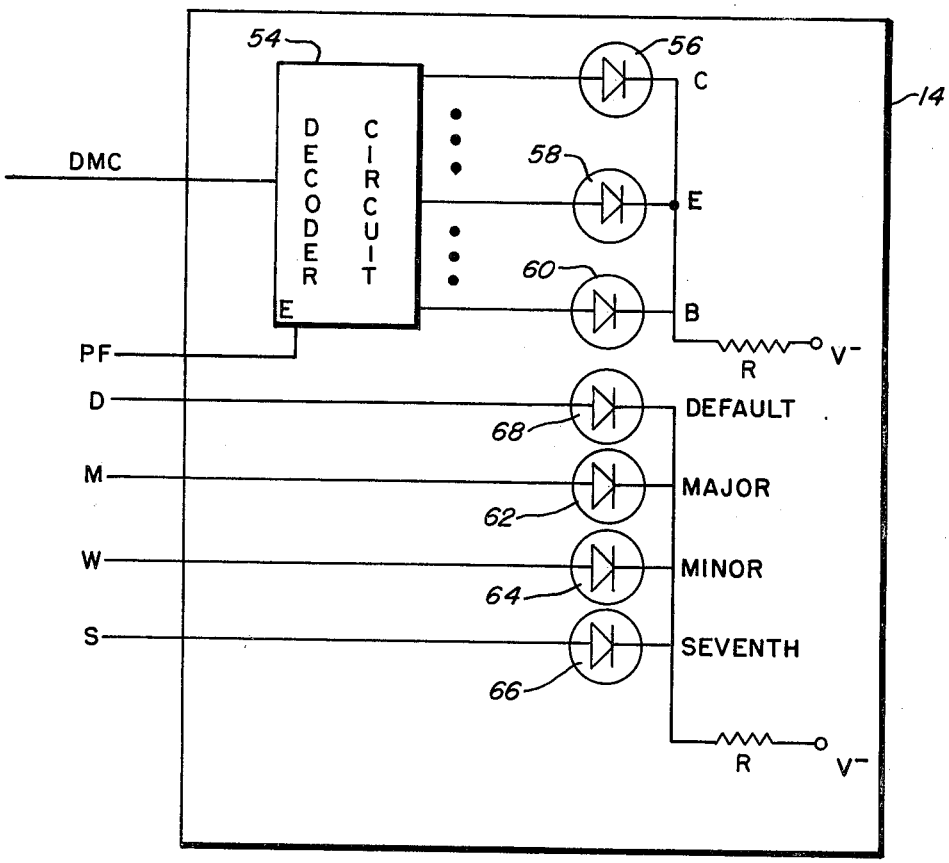
FIG. 3

CHORD RECOGNITION SYSTEM FOR AN ELECTRONIC MUSICAL INSTRUMENT

This application is a continuation-in-part of application Ser. No. 804,739, filed June 8, 1977, and now U.S. Pat. No. 4,144,788.

BACKGROUND OF THE INVENTION

1. Field of the Invention

This invention relates to a chord recognition system for an electronic musical instrument, especially an electronic organ. The chord recognition system is responsive to a combination of keys depressed on the chord section of the manual by the organist and provides output signals representing that the combination of keys forms a recognizable chord, the type of musical chord and the alphabetic designation of the chord or that the combination of keys does not form a recognizable chord. These output signals are applied to other organ circuits such as a visual chord display circuit.

While the present invention is described herein with reference to particular embodiments, it should be understood that the invention is not limited hereto. The chord recognition system of the present invention may be employed in a variety of forms, as one skilled in the art will recognize in light of the present disclosure.

2. Prior Art

Chord recognition systems are known in the electronic organ industry. Electronic organs commonly have keys arranged in one or more manuals and a separate clavier of pedals. In general, the organist plays the melody with the right hand upon the upper manual, the chord with the left hand upon the lower manual and a bass accompaniment upon the pedal clavier with the left foot. The left hand chord performance and the left foot bass are the accompaniments for the melody performance played with the right hand. The left hand chord accompaniment is usually played in consonance with the right hand melody and the left foot bass accompaniment is played at a selected rhythm pattern different than the left hand chord accompaniment.

The chord recognition devices common in electronic organs require the organist to play the notes of a chord in a specific sequence so that the recognition process operates correctly. Other chord recognition devices dedicate logic circuits to recognize certain musical note combinations representing specific alphabetic chords. The amount of logic circuits necessary to recognize a representative number of chords is extremely large and correspondingly costly. The limited number of chords recognized and the playing restrictions placed upon the organist are significant deficiencies of these systems.

An object of the present invention is to provide a chord recognition system for detecting normalized chord patterns corresponding to the keys depressed by the organist and for tracking the root note for recognizable chord patterns.

Another object is to provide a chord recognition system for recognizing normalized chord patterns including inversions and logically restricting pattern identification to eliminate conflicts in recognizable patterns.

Another object is to provide a chord recognition system for providing a signal output representing that a normalized chord pattern is recognized, the type of chord pattern and the alphabetic or root note for the recognized chord pattern.

Another object is to provide a chord recognition system for providing a signal output representing that the keys depressed by the organist do not form a recognizable chord pattern.

Yet another object is to provide a chord recognition system for providing chord related output signals for use in other organ circuits.

Other objects will be apparent from the following summary and detailed description.

BRIEF DESCRIPTION OF THE DRAWINGS

FIG. 1 is a block diagram of the chord recognition system for use in an electronic organ.

FIG. 3 is a partial block diagram of an output circuit responsive to the output signals of the chord recognition system.

SUMMARY

Figure 2:
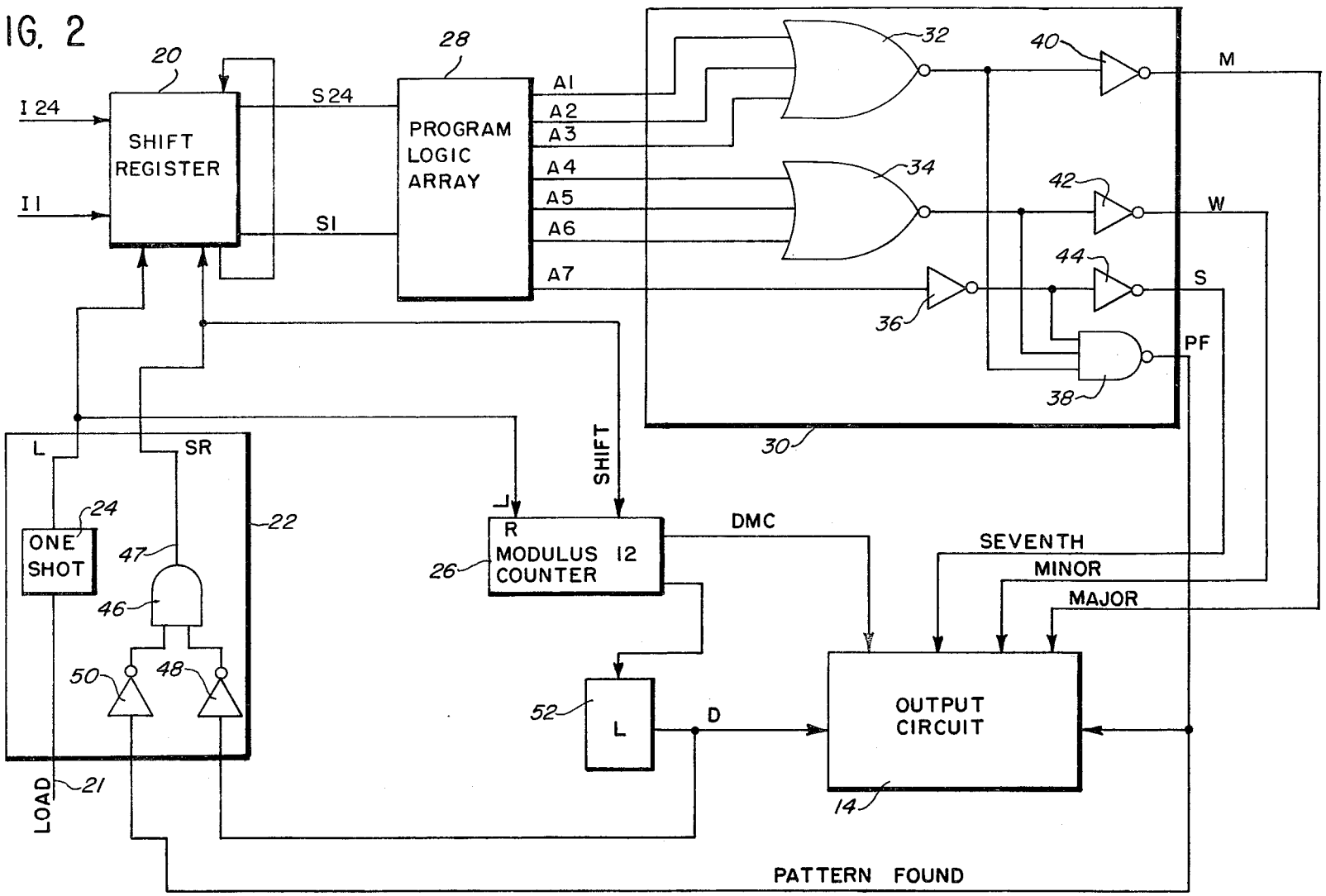
FIG. 2 is a partial block diagram of the chord recognition system.

The present invention is directed to a chord recognition system for an electronic musical instrument, namely, an electronic organ. The chord recognition system provides output recognition signals representing that in response to a combination of keys depressed on the chord or lower manual by the organist a recognizable chord is being played, the type of chord, and the alphabetic key note of the chord or provides an output recognition signal representing that a recognizable chord is not being played. These output signals are used in other organ circuits such as a visual chord display device. The system is connected in parallel relationship to the keying lines of an electronic organ between the keyboard and the standard organ keyer circuits.

A selected number of keys from the chord section of an organ keyboard are connected via their respective keying lines to the data input lines for the chord recognition system. The input data lines are received by a storage circuit in the chord recognition system. The sequence or pattern of all received data lines are compared in a pattern identification circuit with normalized chord patterns to determine if the keys depressed by the instrument player form a recognizable pattern. Each musical chord type, such as a major chord, has a set mathematical relationship between the notes forming the chord and is therefore identifiable if the mathematical pattern is detected. In addition to recognizing the chord pattern in the root position, since the organist may play a chord in an inverted position, that is, some of the alphabetic notes raised an octave, it is desirable to recognize the chord pattern in the root position and all inversions. The pattern identification circuit detects the major, minor, minor sixth, minor seventh, major seventh and dominant seventh chord patterns in all inversions, the major sixth chord pattern in the root and first inversion and the minor seventh in the root and third inversion. The major sixth and minor seventh chords are restricted in the patterns identified to eliminate an overlapping or conflict wherein the same alphabetic notes are arranged in different sequences in both chord patterns.

If the input data from the keying lines does not form a recognizable chord pattern, the storage circuit repositions the data by shifting the data in the first bit position to the last bit position and similarly shifting all other data bits downward one bit position. The shifted data is compared in the pattern identification circuit to match the new or shifted data positions with the normalized chord patterns. The shifting and comparing continues until a pattern match is identified or every possibility is exhausted. A calculation circuit tracks the number of shifts or data transpositions necessary to locate an identifiable chord type pattern in the input data. The value of the calculation circuit represents the alphabetic note of the chord pattern identified. If the chord recognition system compares every possible arrangement of input data patterns with the pattern identification circuit without recognizing a normalized chord pattern, an output signal is generated indicating the absence of a recognizable chord in the input keying data. The output signals from the pattern identification circuit together with the value of the calculation circuit are used to control other circuits within the organ such as to indicate to the organist what chord is being played, to control an arpeggio generator, and to control the selection of additional melody notes to be placed together with a particular chord and melody key combination.

DETAILED DESCRIPTION

FIG. 1 is a block diagram of the chord recognition system for an electronic musical instrument. If the organist depresses a group of keys on the lower manual 10 of a two manual organ, a voltage signal corresponding to each depressed key is placed on a respective keying line. In the preferred embodiment, 20 keys of the lower manual 10 are associated with the chord recognition system, however, it should be apparent to one of ordinary skill in the art that the number of keys may be increased or decreased without departing from the scope of the present invention. Each D.C. level signal on the respective keying lines D1 through D20 is applied both as the data input to the digital chord recognition system 12 and to the standard organ keyer circuits, not shown. The chord recognition system is connected in parallel across the keying lines D1 through D20 and the standard organ keyer circuits. The entire chord recognition system is designed for a large scale integrated circuit system.

The chord recognition system 12 attempts to recognize the structure or pattern of the input data as one of several types of musical chords. The number of musical steps between the notes forming the various types of musical chords is constant regardless of the alphabetic key in which the chord is played. The chord recognition system 12 normalizes the chord identification process to the key of C by receiving the input data information on keying lines D1 through D20 into the multi-bit shift storage circuit. It should be apparent to one of ordinary skill in the art that while a plurality of keying lines are referred to fewer lines could be used with the data being provided in serial form. The outputs of the storage circuit are compared with normalized chord patterns in the pattern identification circuit to determine if the outputs of the storage circuit are in a recognizable chord pattern. If no pattern is recognized, the relative position of the input data within the storage circuit is reorganized or shifted and an attempt to recognize a chord pattern in the shifted data is begun. A calculation circuit parallels the shift operation of the storage circuit to retain the numerical value of the number of shifts necessary before a chord pattern is recognized. If the original input data or the data in any shifted position is in a recognizable chord pattern, the chord recognition system 12 provides signals to output circuit 14 representing that chord pattern is recognizable in the input keying data, the type of chord pattern and the number of shifts necessary to recognize the chord pattern or structure.

The output circuit 14 is responsive to the signals from the chord recognition circuit 12. The output circuit 14 can use the output signals from the chord recognition system in numerous ways such as to provide a visual indication to the organist what chord is being played or to control an arpeggio generator or to provide additional melody notes based upon the chord and melody not selection by the organist. If the entire search sequence of the chord recognition system 12 is completed and no recognizable chord pattern is detected, the chord recognition system provides a default signal to output circuit 14. If the output circuit 14 is a visual indication device as shown in FIG. 3, upon receiving a default signal, it indicates to the organist that no recognizable chord is being played.

FIG. 2 is a partial block diagram of the chord recognition system 12. In the preferred embodiment, the storage circuit is shift register 20 and it receives keying signals on lines I1 through I20. The outputs of the shift register 20 are received by the pattern identification circuit comprising program logic array 28 and chord logic circuit 30. The pattern identification circuit attempts to recognize the input data as a normalized chord pattern. The calculation circuit is counter 26 which sequences each time shift register 20 repositions the input data. It should be noted that other circuits capable of performing the functions of the chord recognition circuits are within the scope of the present invention. If the input data is recognized as an identifiable chord pattern, the chord recognition system 12 provides signals to control the operation of the output circuit 14. The chord recognition system provides a first signal on line PF (pattern found) indicating that the input data received from keying lines D1 through D20 matches a recognizable chord pattern, a second signal on one of the lines M, W or S indicating that the pattern is a major chord, minor chord or seventh chord pattern, and a third signal on line DMC (data move count) indicating the alphabetic note or key of the chord. In the preferred embodiment, the output circuit 14 controls a lamp or other light source to indicate to the organist the chord being played. If the input data on keying lines D1 through D20 is not recognized as an identifiable chord pattern then chord recognition system 12 provides a signal on line D (default) indicating that the input data does not coincide with any recognizable chord pattern and the output circuit 14 controls a lamp or other light source to indicate to the organist that no recognizable chord is being played.

The shift register 20 in FIG. 2 of the chord recognition system 12 receives input information from keying lines D1 through D20 connected to the keyboard. The shift register 20 has twenty-four input lines I1 through I24. A D.C level signal is present at the input lines I1 through I20 if a corresponding keying line has a D.C. level signal representative of a manual key depression by the instrument player. The remaining input lines I21 through I24 are connected in common to a voltage source representative of no input signal on these lines since in the preferred embodiment only twenty keys of the lower manual of an electronic organ are connected to the chord recognition system.

In the preferred embodiment, the first key from the lower manual associated with the chord recognition system is a C note and the respective keying line D1 for this key is connected to input line I1 and to the lowest or first position in the shift register 20. The last or the twentieth key connected from the lower manual is a G note in the next octave above the first key and the respective keying line D20 for the twentieth key is connected to input line I20. It should be apparent to one of ordinary skill in the art that the number of keys of the lower manual connected to the chord recognition system, as well as the selection of keys, can be modified without departing from the scope of the present invention.

The control logic circuit 22 receives a load pulse on line 21 from a legato detector, not shown. A legato detector is a standard circuit in an electronic organ which produces an output pulse of finite duration upon the depression of any key on the lower manual of a two-manual organ regardless of how many prior keys are depressed and retained down. It should be apparent to one of ordinary skill in the art that other means to produce a pulse output signal for each key depression could be used in place of the legato detector. The load pulse on line 21 is applied to a standard one shot circuit 24 which provides an output pulse on the logic 1 to logic 0 transition on line 21, so that when the load pulse on line 21 is gone, the control circuit 22 provides a signal to the shift register 20 on line L to load the signals at the input lines I1 through I20 as is well-known in the art. The signal on line L is also applied to the reset input of counter 26.

The output lines S1 through S24 of the shift register 20 are connected to a programmed logic array or read only memory 28. The logic array 28 is programmed in a manner well-known to those of ordinary skill in the art to receive the outputs S1 through S24 and to determine which outputs or which combination of outputs has a D.C. level signal. The programmed logic array 28 provides an output signal on one of the lines A1 through A7 to indicate that the output lines S1 through S24 of the shift register 20 are in the musically structured format or pattern of a major chord, a major seventh chord, a major sixth chord, a minor chord, a minor seventh chord, a minor sixth chord, or a dominant seventh chord. It should be apparent to one of ordinary skill in the art that additional musically structured patterns such as diminished chords could be included.

The musical pattern relationship between notes forming a specific type of chord are uniform. These patterns are not altered if the chord is played in a different key. Therefore, all chord pattern identification is normalized to a single key and in the preferred embodiment the key of C is selected. The musical structure for a major triad chord is the root (alphabetical note), a major third (up four half steps from the root), and the fifth (up seven half steps from the root.) A half step is the interval between any key and the adjacent key. The frequency ratio between any two notes a half step apart is 1:1.059. A minor triad chord consists of the root note, a minor third (up three half steps) and the fifth. A dominant seventh chord consists of the root note, a major third, the fifth and the flatted seventh. A major seventh chord consists of the root note, a major third, the fifth, and the seventh. A minor seventh chord consists of a root note, a minor third, the fifth, and the flatted seventh. A major sixth consists of a root note, a major third, the fifth, and the sixth. A minor sixth consists of the root note, a minor third, the fifth, and the sixth. The code for the programmable logic array 28 with the numbers indicating the output lines S1 through S24 of shift register 20 which have a logic 1 output signal is as follows:

CHART 1

| CHORD TYPE: | PATTERN RECOGNITION CODE: |
|---|---|
| major chord | (1 + 13) · (5 + 17) · (8 + 20) |
| major seventh chord | (1 + 13) · (5 + 17) · (8 + 20) · (12 + 24) |
| major sixth chord | (1 + 13) · (5) · (8) · (10) |
| minor chord | (1 + 13) · (4 + 16) · (8 + 20) |
| minor seventh chord | [(1) · (4) · (8) + (13) · (16) · (20)] · (11) |
| minor sixth chord | (1 + 13) · (4 + 16) · (8 + 20) · (10 + 22) |
| dominant seventh chord | (1 + 13) · (5 + 17) · (8 + 20) · (11 + 23) |

The remaining output lines from register 20 not numerically included in the respective equations or formulas must be at a logic 0 state and this requirement is to be considered part of each of the above equations.

In accord with the above code, a major chord pattern is detected on line A1 if, for example, the shift register 20 has an output signal on line S1, line S5 and line S8. The entire code of the program logic array 28 specifies that a major chord is recognized if the data register 20 has an output signal on the first (S1) or thirteenth (S13) line and the fifth (S5) or seventeenth (S17) line and the eighth (S8) or twentieth (S20) line. This mathematical pattern is necessary since it is possible for the instrument player to play a chord inversion and the code of the program logic array 28 for a major chord pattern also identifies inverted chords. In a similar manner, the major seventh chord, the minor chord, the minor sixth chord, and the dominant seventh chord are programmed for recognition through the above pattern code which includes all of their inversions. However, the major sixth chord and the minor seventh chord are not detected through all of their inversions according to the above pattern codes, since if all inversions are attempted to be recognized a conflict occurs.

By a conflict, it is meant that the same letter note combinations are possible for certain specific major sixth and minor seventh chords. Therefore, a selection decision has been made and programmed into the logic array 28 so that when such a conflict in letter note combinations occurs, one musical structured chord combination takes priority over the other. One specific type of chord contradiction occurs between a C major sixth chord with the alphabetic note combination of C, E, G, A, and an A minor seventh chord with the note combination of A, C, E, G. Thus, it is clear that for both the C major sixth chord and the A minor seventh chord, the same combination of alphabetic notes are played with merely the alphabetic notes being rearranged in a different sequence. This contradiction in chord recognition based upon the musical structure or pattern of the various chords precludes the ability to recognize a major sixth and all its possible inversions. Therefore, in the code for the programmable logic array 28 as set forth above, the decision has been made to exclude the possible contradiction by restricting the identification criterion for the major sixth chord and minor seventh chord. In the preferred embodiment, the major sixth chord is identified only in the root position and first inversion position of the chord and the minor seventh is identified only in the root and third inversion of the chord.

The outputs of the programmable logic array 28 on lines A1 through A7 are connected to the chord logic circuit 30. The lines A1, A2, and A3 representing a major, major sixth, and major seventh chord are received by the NOR gate 32, the output lines A4, A5, and A6 representing a minor, minor sixth, and minor seventh chord are received by the NOR gate 34 and the output of A7 representing a dominant seventh chord is received by inverter 36. If a signal is received at any of the inputs to the NOR gates 32 or 34, the respective output line changes logic state. The output of NOR gate 32, NOR gate 34, and inverter 36 are connected to the inputs of NAND gate 38. Furthermore, the outputs of NOR gate 32, NOR gate 34, and inverter 36 are respectively connected to inverters 40, 42 and 44. Thus, if the major chord pattern is detected, a logic 1 state signal on line A1 is present at the first input to NOR gate 32, the output of NOR gate 32 changes from a logic 1 state to a logic 0 state. The output of inverter 40 on line M is at a logic 1 state indicating a major chord pattern. In addition, the first input to NAND gate 38 from the output of NOR gate 32 is at a logic 0 state and the output line PF of the NAND gate 38 changes to a logic 1 state indicating that a chord pattern is identified.

Thus, if the signals at output lines S1 through S24 of shift register 20 form a major chord pattern identifiable by the programmed logic array 28, the chord logic circuit 30 provides an output signal on line M and an output signal on line PF. If the program logic array 28 identifies a minor chord pattern on line A4, a minor sixth chord pattern on line A5 or a minor seventh chord pattern on line A6, the line W indicating a minor chord pattern, the output of NAND gate 38 changes state to a logic 1 indicating that a chord pattern match is found. If the programmed logic array 28 identifies a dominant seventh chord pattern on line A7, the output line S indicating the dominant seventh chord is at a logic 1 state output and the output of NAND gate 38 changes state to a logic 1 indicating a chord pattern is found.

The signals on lines M, W or S are applied to the output circuit 14. The signal on line PF is applied as a control to the output circuit and as an input signal to control logic circuit 22.

If no chord pattern according to the above logic code is detected, the shift register 20 under direction from the control logic 22 shifts the input data, if any, in the first bit position into the twenty-fourth bit position and any data in the second bit position downward into the first bit position and similarly throughout the register 20. Now, the data information, if any, which was received at input line I2 to the shift register 20 is in the first bit position as if it were received on line I1. The output line S1 through S24 of shift register 20 are now compared to the chord pattern combinations of the programmed logic array 28. If no chord pattern is recognized in the shifted data, the register 20 again shifts all the data information one bit position and the comparison is repeated. Therefore, regardless of what key a chord is played in by the instrument player, the chord recognition system 12 recognizes the musical structure unique to the type of chord.

The above-described shifting of register 20 is controlled by the line SR from the control logic circuit 22. The inputs to AND gate 46 via inverters 48 and 50 are $\overline{D}$ and $\overline{PF}$, respectively, indicating that the system is not in default and no chord pattern is found. The output of AND gate 46 on line 47 is at a logic 1 state and controls when the register 20 shifts. The logic discussed throughout the specification is dynamic phased clock logic which is well-known to those of ordinary skill in the art and hence for clarity of description no specific reference is made to the clock signals inherent in the system. Thus, when the chord recognition system does not recognize a chord pattern in the output lines of the register 20 and the system is not yet in the default mode of operation, the output line SR of the control logic circuit 22 forces the register 20 to shift the respective positions of the input data. After each data shift, if no pattern match is found and the system is not yet in default, the input lines $\overline{D}$ and $\overline{PF}$ to AND gate 46 remain at a logic 1 state and the register 20 again shifts the respective positions of the input data.

The load pulse on line L from the control logic 22 is also applied to the reset input of counter 26. Therefore, upon the depression of every new key by the instrument player, the counter 26 is reset. The counter 26 receives from control logic 22 the same control inputs as the shift register 20 and therefore, sequences in sync with the shifting of register 20. For example, if D.C. level signals are originally received at inputs I5, I9 and I12 of shift register 20 and the register shifts four times, the input data is now at shift register bit positions 1, 5 and 8 which provide a D.C. level signal at output lines S1, S5 and S8. The logic array 28 identifies the S1, S5 and S8 pattern as a major chord pattern and provides an output signal on line M indicating a major chord pattern and on line PF indicating that a chord pattern is identified. The signal on line PF is received by the control circuit 22. The input to AND gate 46 on line $\overline{PF}$ changes logic state indicating that a pattern is found. The output of AND gate 46 on line 47 changes logic state to a logic 0. The shift register 20 and the counter 26 are disabled. The output of counter 26 on line DMC is a binary value indicating the number of shifts or data moves necessary before a chord pattern is recognized by logic array 28. Thus, for the above example, a signal output on line M indicates that a major chord pattern is being played and the DMC or data move count output signal form counter 26 is the binary value 0100 which indicates that four shifts were necessary to recognize the major chord pattern. From this information, it is clear that the instrument player is playing the E major chord.

If a major chord pattern is detected by programmed logic array 28 without any shifts of data in register 20, the counter 26 would have a binary output 0000 indicating that no shifts were required and the chord identification would be a C major chord. Thus, the chord recognition system is normalized to the key of C. The musical chord pattern is identified as a major chord pattern, a minor chord pattern, or a seventh chord pattern. The number of shifts required by the register 20 before a chord pattern is identified represents the root or alphabetic note of the identified chord pattern. Since the programmed logic array 28 is normalized to identify chord patterns and not specific alphabetic chords, the size is greatly reduced without a decrease in the identification capacity.

The counter 26 is an up-down counter which counts to twenty-four in modulus twelve with a one bit carry. The DMC output or data move count of counter 26 represents the alphabetic note of the recognized chord pattern and modulus 12 is an appropriate mathematical number system for recognition since there are only twelve notes in an octave. When the counter 26 reaches the twelfth count and recycles to begin over, it provides a carry bit output which is connected to latch circuit 52. The counter 26 continues to count to eleven (0000 through 1011) for the second time. If the counter 26 recycles for the second time, indicating that register 20 has shifted twenty-four times, through all possible data input combinations, without the programmed logic array 28 identifying a chord pattern, a second carry bit is provided to latch circuit 52. The second carry bit changes the output logic state of latch circuit 52 on line D to a logic 1. The chord recognition system now defaults.

If the chord recognition system identifies a chord pattern, the signal on lines M, W or S from logic circuit 30 and the data move count on line DMC from modulus 12 counter 26 are used as inputs to the output circuit 14. The output circuit 14 also receives an enable signal on line PF and a signal on line D.

FIG. 3 is a partial block diagram of the output circuit 14. A one of twelve decoder 54 receives on line DMC the four bit binary signal representing the number of shifts of the counter 26. The decoder 54 also receives an enable signal on line PF and is enabled when line PF is at a logic 1 state. When enabled, the decoder 54 provides an output signal on one of twelve output lines depending upon the binary value at its input. Such binary decoders are well-known in the art and further description is considered unnecessary.

The first output line of the decoder 54 is connected to the anode of LED 56. The fourth output line of decoder 54 is connected to the anode of LED 58. The twelfth output line of the decoder 54 is connected to the anode of LED 60. Each of the remaining output lines of decoder 54 are respectively connected to the anode of a corresponding LED device. Only three LED devices have been illustrated for the purpose of convenience. The cathode of each LED device connected to the outputs of decoder 54 is connected through a resistance R to a negative voltage source, V−. The M, W and S lines are respectively connected to the anode of LED devices 62, 64 and 66. The D line is connected to the anode of LED device 68. The cathode of each LED device 62, 64, 66 and 68 is tied together and connected through a resistance R to a separate negative voltage source V−.

Now, in the example previously given, shift register 20 receives data at its input lines I5, I9 and I12 and shifts four times to reposition the data in register bit positions 1, 5 and 8. The data move count is the binary 0100, indicating the four shifts. This binary signal is received by decoder 54 which provides an output signal on line 4. The output signal on line 4 puts a positive voltage at the anode of LED 58, activating the device. In the preferred embodiment the entire output circuit 14 is mounted on the organ console at a location visible to the organist. Next to the LED 58, in a location visible to the instrument player is the letter E. Thus, when LED 58 is illuminated, the organist is informed that a chord in the key of E is being played. Adjacent LED device 56 is the letter C corresponding to the alphabetic note or Key C. The same sequence is followed throughout the scale with the letter B being adjacent LED device 60.

In the above example, chord logic circuit 30 provides an output signal on line M indicating that a major chord pattern has been detected. The output signal on line M is applied to the anode of LED 62, thereby energizing the LED. Adjacent LED 62 in a location visible to the instrument player is the printed word "major". Similarly, adjacent LED 64 is the printed word "minor", adjacent LED 66 is the printed word "seventh", and adjacent LED 68 is the printed word "default". It should be apparent to one of ordinary skill that other appropriate LED devices can be added depending on the type of chord signals recognized. In the above example, the organist is playing the E major chord and the LED device 58 and 62 are energized.

If the search sequence of the register 20 is completed without the data information at its input corresponding to a chord pattern, the counter 26 provides a signal to latch 52. The output signal of latch 52 changes state to a logic 1 which energizes LED 68 indicating to the organist that no recognizable chord is being played.

It is to be understood that the present disclosure is to be interpreted in its broadest sense and the invention is not to be limited to the specific embodiments disclosed. Furthermore, the embodiments set forth can be modified or varied by applying current knowledge without departing from the spirit and scope of the novel concepts of the invention.

Having described the invention, what is claimed is:

1. A chord recognition system providing a plurality of output recognition signals for use in an electronic organ having a plurality of lines with keying data and an output circuit responsive to at least one of said recognition signals, said chord recognition system comprising:

storage means for receiving said keying data and having a plurality of output signals corresponding to said keying data;

pattern identification means responsive to said plurality of output signals of said storage means for recognizing the relationship between said keying data and a normalized chord pattern;

said pattern identification means having a chord pattern output signal and a pattern found output signal if said keying data matches a normalized chord pattern;

control ciruit for providing a shift signal to said storage means for repositioning said keying data;

calculation means responsive to said shift signal for providing a data move output signal representing the number of shifts of said storage means; and, said control circuit responsive to said pattern found output signal of said pattern identification means for disabling said storage means and said calculation means.

2. A chord recognition system as set forth in claim 1 wherein said data move output signal represents the alphabetic note of said keying data.

3. A chord recognition system as set forth in claim 2 wherein said chord pattern output signal of said pattern identification means represents a chord pattern in said keying data.

4. A chord recognition system as set forth in claim 1 or 3 wherein said pattern identification means eliminates conflicts between the alphabetic notes forming normalized chord patterns.

5. A chord recognition system as set forth in claim 1 wherein said storage means is a shift register having a plurality of input lines each connected to one of said lines with keying data.

6. A chord recognition system as set forth in claim 1 or 5 wherein said pattern identification means comprises:

a programmed logic array responsive to said output signals from said storage means and having a plurality of output signals; and, a chord logic circuit responsive to said output signals of said programmed logic array.

7. A chord recognition system as set forth in claim 1 wherein said output circuit comprises:

a decoder circuit responsive to said data move output signal of said calculation circuit and having a plurality of note output lines; and, illumination means responsive to said note output lines of said decoder circuit and said chord pattern output signal for indicating the alphabetic chord of said keying data.

8. A chord recognition system as set forth in claim 1 further comprising:

latch means responsive to said calculation means for providing a default output signal if said data move output signal exceeds a predetermined value; and, said control circuit responsive to said default output signal of said latch means for disabling said storage means and said calculation means.

9. A chord recognition system as set forth in claim 8 wherein said output circuit comprises:

a decoder circuit responsive to said data move output signal of said calculation circuit and having a plurality of note output lines;

illumination means responsive to said note output lines of said decoder circuit and said chord pattern output signal for indicating the alphabetic chord of said keying data; and, said illumination means further responsive to said default output signal of said latch to indicate that said keying data is not a recognizable chord pattern.

10. A chord recognition system providing a plurality of output recognition signals for use in an electronic organ having a keyboard, a plurality of lines with keying data connected to said keyboard and an output circuit responsive to at least one of said recognition signals, said chord recognition system comprising:

register means having a plurality of input lines responsive to at least some of said plurality of lines with keying data and having a plurality of output signals corresponding to said keying data;

pattern identification means having a plurality of normalized chord patterns and being responsive to said output signals of said register means for comparing said keying data with said normalized chord patterns:

said pattern identification means providing a chord pattern output signal and a pattern found output signal when said keying data matches one of said normalized chord patterns;

a control circuit for providing a shift signal to said register for repositioning said keying data when no match is determined in said pattern identification means;

a counter circuit responsive to said shift signal for providing a data move output signal representing the number of shifts of said register; and, said control circuit responsive to said pattern found output signal of said pattern identification means for disabling said register and said counter.

11. A chord recognition system as set forth in claim 10 further comprising:

latch means responsive to said counter for providing a default output signal if said data move output signal exceeds a predetermined value; and, said control circuit responsive to said default output signal of said latch means for disabling said register and said counter.

12. A chord recognition system as set forth in claim 11 wherein said data move output signal represents the alphabetic note of said keying data.

13. A chord recognition system as set forth in claim 12 wherein said chord pattern output signal of said pattern identification means represents a chord pattern in said keying data.

14. A chord recognition system as set forth in claim 13 wherein said pattern identification means eliminates conflicts between the alphabetic notes forming normalized chord patterns.

15. A chord recognition system as set forth in claim 13 or 14 wherein said output circuit comprises:

a decoder circuit responsive to said data move output signal of said counter circuit and having a plurality of note output lines; and, illumination means responsive to said note output lines of said decoder circuit and said chord pattern output signal for indicating the alphabetic chord of said keying data.

16. A chord recognition system as set forth in claim 15 wherein said illumination means is further responsive to said default output signal of said latch to indicate that said keying data is not a recognizable chord pattern.

17. A chord recognition system providing a plurality of output recognition signals for use in an electronic organ having a plurality of lines with keying data and an output circuit responsive to at least one of said recognition signals, said chord recognition system comprising:

storage means for receiving said keying data and having a plurality of output signals corresponding to said keying data;

pattern identification means responsive to said plurality of output signals of said storage means for recognizing the relationship between said keying data and a normalized chord pattern;

said pattern identification means having a chord pattern output signal and a pattern found output signal if said keying data matches a normalized chord pattern;

control circuit for providing a shift signal to said storage means for repositioning said keying data;

calculation means responsive to said shift signal for providing a data move output signal representing the number of shifts of said storage means.

18. A chord recognition system as set forth in claim 17 where said control circuit is responsive to said pattern found output signal of said pattern identification means for disabling said calculation means.

19. A chord recognition system as set forth in claim 18 wherein said data move output signal represents the alphabetic note of said keying data.

20. A chord recognition system as set forth in claim 19 wherein said chord pattern output signal of said pattern identification means represents a chord pattern in said keying data.

21. A chord recognition system as set forth in claim 17 or 20 wherein said pattern identification means eliminates conflicts between the alphabetic notes forming normalized chord patterns.

22. A chord recognition system as set forth in claim 18 wherein said storage means is a shift register having a plurality of input lines each connected to one of said lines with keying data.

23. A chord recognition system as set forth in claim 22 wherein said pattern identification means comprises:

a programmed logic array responsive to said output signals from said storage means and having a plurality of output signals; and a chord logic circuit responsive to said output signals of said programmed logic array.

24. A chord recognition system as set forth in claim 18 wherein said output circuit comprises:

a decoder circuit responsive to said data move output signal of said calculation circuit and having a plurality of note output lines; and, illumination means responsive to said note output lines of said decoder circuit and said chord pattern output signal for indicating the alphabetic chord of said keying data.

25. A chord recognition system as set forth in claim 18 further comprising:

latch means responsive to said calculation means for providing a default output signal if said data move output signal exceeds a predetermined value; and, said control circuit responsive to said default output signal of said latch means for disabling said storage means and said calculation means.

* * * * *